US005695788A

United States Patent [19]

Woods

[11] Patent Number: 5,695,788

[45] Date of Patent: Dec. 9, 1997

[54] WALL TEXTURE TOOL

[75] Inventor: John Robert Woods, Woodland Hills, Calif.

[73] Assignee: Spraytex, Inc., Arlington, Va.

[21] Appl. No.: 629,580

[22] Filed: Apr. 9, 1996

[51] Int. Cl.[6] ..... B05C 17/10

[52] U.S. Cl. ..... 425/87; 425/458; 15/235.7; 15/245.1

[58] Field of Search ..... 15/235.5, 235.6, 15/235.7, 235.8, 245.1; 264/108; 425/87, 458, 191

[56] References Cited

U.S. PATENT DOCUMENTS

| | | | |
|---|---|---|---|
| 760,027 | 5/1904 | Selley . | |
| 796,246 | 8/1905 | Printz . | |
| 1,038,180 | 9/1912 | Moreland | 425/458 |
| 1,126,253 | 1/1915 | Morris . | |
| 1,829,479 | 6/1931 | Elkins . | |
| 2,594,606 | 4/1952 | Ames . | |
| 3,056,159 | 10/1962 | Hoveland | 15/235.7 |
| 3,087,654 | 4/1963 | Moore | 425/458 |
| 3,932,101 | 1/1976 | Johnson et al. . | |
| 4,021,175 | 5/1977 | Wuhrmann et al. | 425/191 |
| 4,032,283 | 6/1977 | Johnson et al. . | |
| 4,116,604 | 9/1978 | Johnson et al. . | |
| 4,230,441 | 10/1980 | Heronema . | |
| 4,368,089 | 1/1983 | Smith | 264/108 |
| 4,451,223 | 5/1984 | Mower et al. . | |
| 4,767,297 | 8/1988 | Mower et al. . | |
| 4,824,443 | 2/1989 | Ames . | |
| 5,010,618 | 4/1991 | Croft | 425/458 |
| 5,017,113 | 5/1991 | Heaton et al. | 425/87 |
| 5,033,951 | 7/1991 | Wok | 425/458 |
| 5,188,784 | 2/1993 | Kamal et al. | 264/108 |
| 5,192,558 | 3/1993 | Sparrow et al. | 425/458 |
| 5,277,511 | 1/1994 | Stockton . | |
| 5,368,461 | 11/1994 | Murphy . | |
| 5,467,497 | 11/1995 | Greene et al. | 425/458 |

FOREIGN PATENT DOCUMENTS

| | | | |
|---|---|---|---|
| 2220813 | 11/1972 | Germany | 425/458 |

*Primary Examiner*—Jay H. Woo
*Assistant Examiner*—Minh-Chau T. Pham
*Attorney, Agent, or Firm*—Loeb & Loeb LLP

[57] ABSTRACT

A tool for use in connection with a wall covering material source having a nozzle to dispense wall material to be applied to a wall. The has a plate having a front surface, and a back surface which is adapted to slide along the wall surface. The back surface defines an opening, and the plate defines a passageway passing through the plate and coupled to the back surface opening. A tube connected to the front surface of the plate and coupled to the passageway of the plate is adapted to receive the nozzle of the wall material source. The plate passageway directs the wall material dispensed from the source nozzle to the back surface opening to be delivered for application to the wall surface.

21 Claims, 3 Drawing Sheets

WALL TEXTURE TOOL

BACKGROUND OF THE INVENTION

1. Field of the Invention

The present invention relates generally to a wall tool and more specifically to a tool for use in applying a wall covering material to a wall surface.

2. Description of Related Art

For many years, interior walls of buildings have been made of plaster or plasterboard, including gypsum boards often referred to as "drywall". While such walls are attractive, they are also relatively easily damaged. For example, a hard object such as a chair striking the wall can easily make a small hole or crack in plaster or plasterboard walls. Therefore, a great demand exists for tools to repair the holes or cracks formed in plaster or plasterboard walls.

Different types of repairing tools are available for repairing damaged walls. However, many such tools are not well adapted for repairing small holes or cracks, particularly when damaged portions are located near or in a corner or edge of the wall. Repairing such small holes or cracks requires one to apply a plaster precisely to the holes or cracks and then to smooth it out evenly. In a typical repair operation, a wall covering material, such as spackle or grouting, is scooped from a receptacle and applied to the wall surface with a hand tool such as a spatula. Alternatively, the wall covering is instead dispensed onto the wall surface through a nozzle and is smoothed with a separate hand tool. These prior methods have been very time consuming. Therefore, a need exits to develop a hand tool for repairing small holes or cracks on a surface or a corner of a plaster wall.

SUMMARY OF THE INVENTION

Accordingly, it is an object of the present invention to provide an inexpensive tool for repairing a small hole or crack in a plaster wall or the like.

A tool in accordance with one embodiment of the present invention generally comprises a tube and a plate. The plate has a front surface and a back surface which are adapted to slide along the wall surface. The back surface has an opening, and the plate has a passageway passing through the plate and coupled to the back surface opening. The tube is connected to the front surface and is coupled to the passageway and is adapted to receive the nozzle of a wall covering dispenser material. The plate passageway directs the wall material dispensed from the nozzle to the back surface opening to be delivered for application to the wall surface.

In a preferred embodiment, the back surface of the plate comprises an indentation beginning from the opening on the back surface and extending toward the top portion of the back surface, wherein the depth of the indentation gradually decreases toward the top portion such that the indentation fades out adjacent the top portion of the plate. As a result, as the back surface of the plate slides along the wall surface, wall covering material delivered from the opening of the back surface is spread along the indentation to the top portion of the plate and is smoothed onto the wall surface evenly.

In another aspect of the invention, the plate of the tool has a truncated triangular shape with the truncated apex as the lower portion of the plate. The indentation of the plate has a triangular shape with an apex of the triangle positioned adjacent to the opening of the plate. A tool in accordance with this embodiment facilitates the smoothing of wall covering material to fill and cover holes or cracks on the surface of a wall.

In yet another embodiment, the back surface of the plate comprises a center portion in which the opening and the indentation are located in the center portion. Two flat surfaces extend radially from the center portion, each of which is adapted to slide along one of a pair of adjacent wall surfaces coupled at an angle which defines a wall corner. Wall covering material delivered from the back surface opening of the plate is smoothed onto the adjacent wall surfaces and the wall corner by the two flat surfaces and the center portion of the plate as the plate slides along the adjacent wall surfaces and the wall corner respectively. In one embodiment, the tool is adapted to be used on an inside corner. In another embodiment, the tool is adapted to be used on an outside corner.

The invention is defined in its fullest scope in the appended claims and is described below in its preferred embodiments.

BRIEF DESCRIPTION OF THE DRAWINGS

The above-mentioned and other features of this invention and the manner of obtaining them will become more apparent, and will be best understood by reference to the following description, taken in conjunction with the accompanying drawings. Understanding that these drawings depict only a typical embodiment of the invention and are not therefore to be considered limiting of its scope, the invention will be described and explained with additional specificity and detail through the use of the accompanied drawings in which.

DETAILED DESCRIPTION OF THE INVENTION

Figure 1:
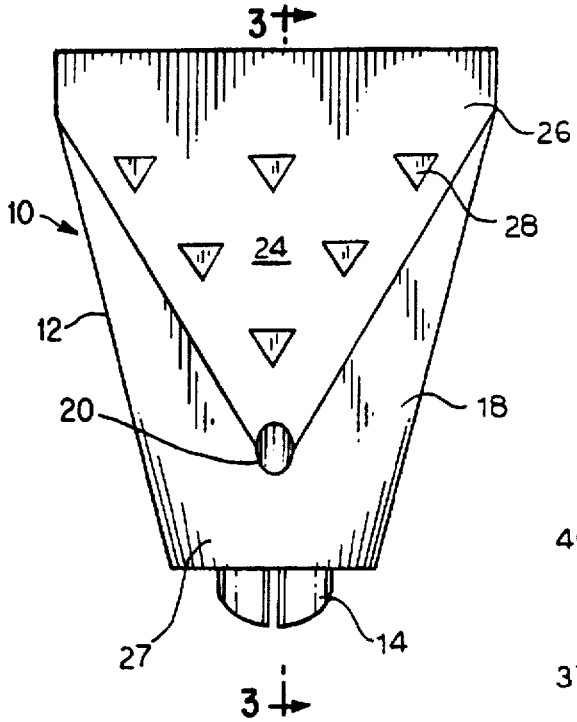
FIG. 1 shows a back perspective view of a preferred embodiment of the tool of the present invention.

The present invention provides a tool for use in connection with a wall covering material dispenser having a nozzle to dispense wall material to be applied to a wall surface. The tool of the present invention is particularly useful for applying a wall covering material to a wall surface for repairing small holes or cracks on the surface or a corner of the wall. The wall material preferably is a texture material which can be applied to a wall surface by the tool of the present invention. The example of the texture material includes but is not limited to a plaster material, a drywall mud material, spackle, grouting, and a cementitious material, etc. The tool of present invention may be used, for example, to repair small holes or cracks on the surface of a plaster or plasterboard wall. Alternatively, it may be used to fill cracks and gaps between individual sheets of dry wall in a new installation of drywall or other plasterboard. The tool of the present invention can be made of a resilient material, such as but not limited to a relatively rigid plastic material.

As shown in FIGS. 1 through 4, the tool 10 comprises a plate 12 and a tube 14. The plate 12 has a front surface 16, and a back surface 18 which is adapted to slide along a wall surface 2. The back surface 18 has an opening 20. The plate 12 has a passageway 22 passing through the plate 12 and coupled to the back surface opening 20. The tube 14 is coupled to the passageway 22 and is adapted to receive the nozzle 4 of a wall material source 6. When the wall material 8 is dispensed from the source nozzle 4, it will be directed by the passageway 22 to the back surface opening 20 and be applied to the wall surface 2 while the back surface 18 of the plate 12 is sliding along the wall surface 2.

In a preferred embodiment, the back surface 18 of the plate has an indentation 24 beginning from the opening 20 and extending toward the top portion 26 of the plate 12, wherein the depth of the indentation 24 gradually decreases along the extension and fades when the indentation 24 reaches the top portion 26. When the back surface 18 is sliding along the wall surface 2, the wall material 8 delivered from the opening 20 of the back surface 18 will spread along the indentation 24 to the top portion 26 of the plate 12 and be smoothed onto the wall surface 2 evenly.

Figure 3:
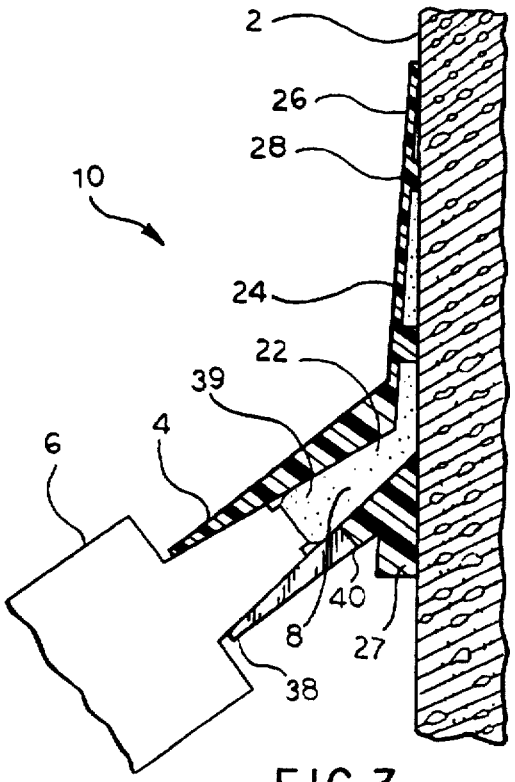
FIG. 3 shows a cross-section view taken along line 3—3 of FIG. 1.
Figure 4:
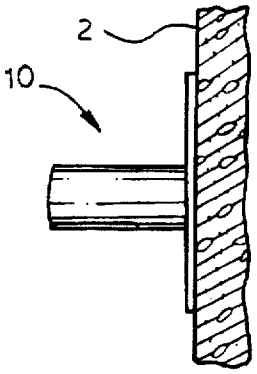
FIG. 4 shows a top perspective view of the tool of FIG. 1.
Figure 5:
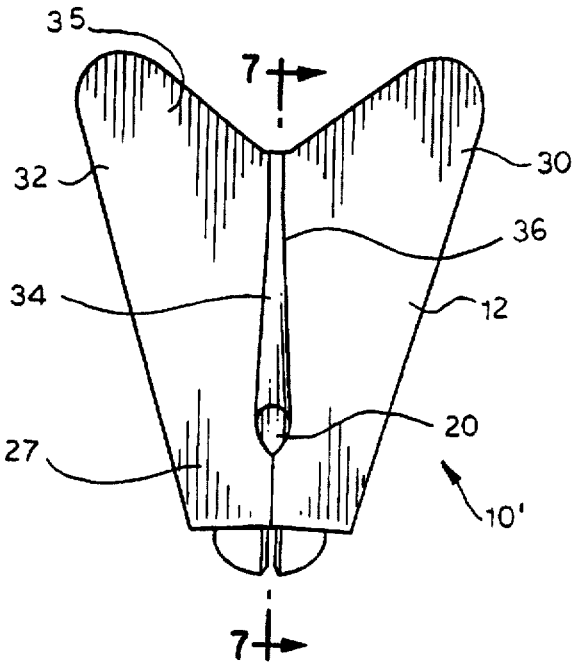
FIG. 5 shows a back perspective view of another preferred embodiment of the tool of the present invention.
Figure 6:
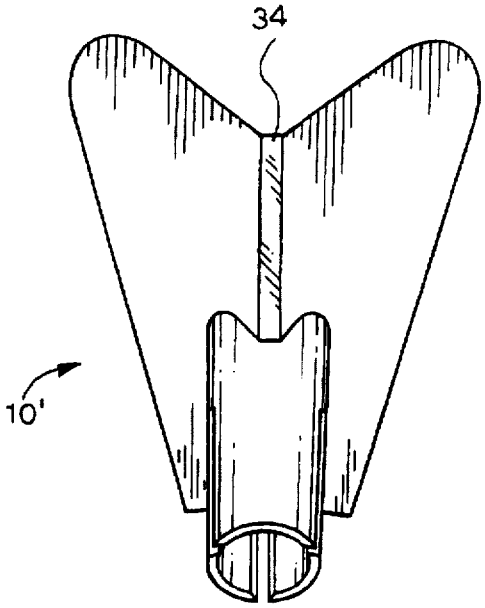
FIG. 6 shows a front perspective view of the tool of FIG. 5.

In the preferred embodiment as shown in FIG. 1, the plate 12 has a truncated triangular shape with the truncated apex as the lower portion 27 of the plate. The top portion 26 has preferably a rectangular shape. Preferably, the thickness of the planar plate may be tapered toward the top portion 26 to form a smooth transition from the lower portion 27 to the existing wall surface 2 as shown in FIG. 3. The indentation 24 has a triangular shape with one apex beginning from the opening 20. Within the indentation, there are multiple triangular shaped protrusions 28 arranged in a triangular fashion with respect to one another. The height of each protrusion 28 is the same as the depth of the indentation 24 at the same location, so that the top surface of the protrusion and the periphery of the back surface of the plate are substantially coplanar for smoothly applying the wall material 8 to the wall surface 2. The protrusions 28 facilitate even spreading of the wall material 8 with the indention 24 while providing even and smooth application of the wall material 8 to the wall surface 2. It is recognized that the plate may have a shape other than that of a truncated triangle, and the indentation or the protrusion may also have a shape other than that of a triangle to achieve similar aims. Likewise, the number of the protrusions may be changed and the positions of the protrusions may be arranged in a different fashion other than a triangle with respect to one another.

Figure 7:
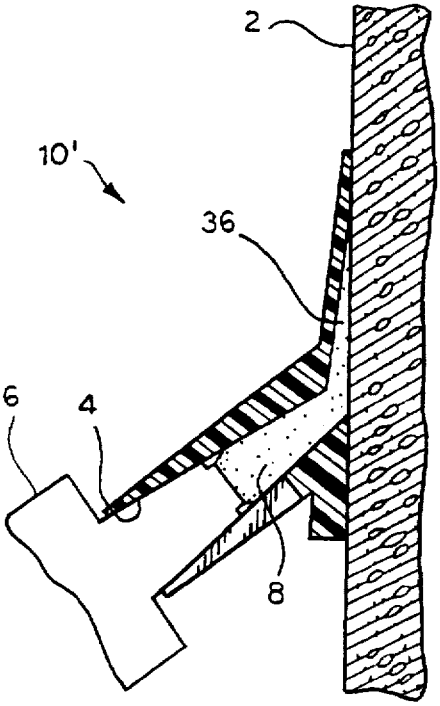
FIG. 7 shows a cross-section view taken along line 7—7 of FIG. 5.
Figure 8:
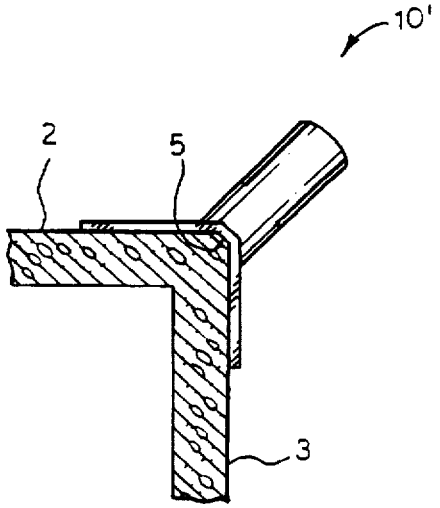
FIG. 8 shows a top perspective view of the tool of FIG. 5.
Figure 9:
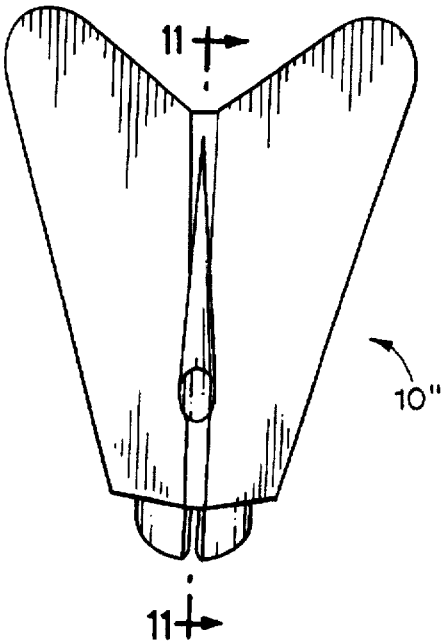
FIG. 9 shows a back perspective view of yet another preferred embodiment of the tool of the present invention.
Figure 10:
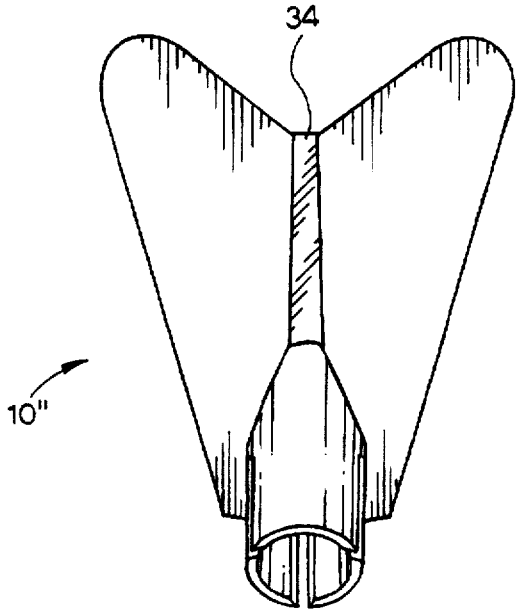
FIG. 10 shows a front perspective view of the tool of FIG. 9.
Figure 11:
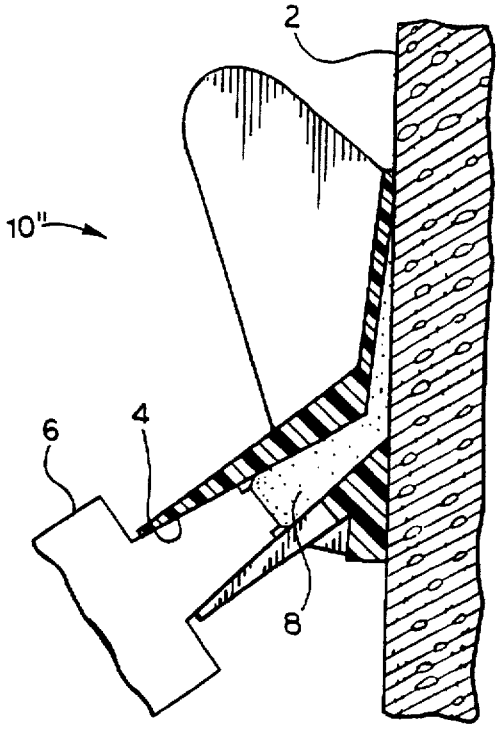
FIG. 11 shows a cross-section view taken along line 11—11 of FIG. 9.
Figure 12:
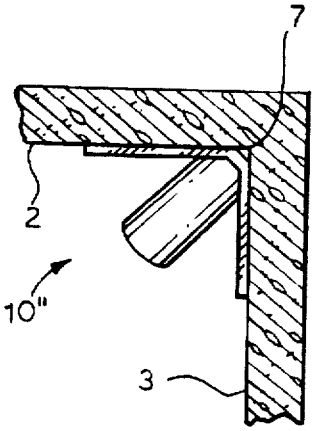
FIG. 12 shows a top perspective view of the tool of FIG. 9.

In other preferred embodiments as shown in FIGS. 5 through 12, the back surface of the plate comprises two flat surfaces 30 and 32, each of which is adapted to slide along one of a pair of adjacent wall surfaces 2 and 3 coupled at an angle which defines a wall corner as shown in FIGS. 8 and 12. Preferably, the back surface further comprises a center portion 34, wherein the opening 20 is located adjacent to the lower portion 27 of the plate 12. An indentation 36 is located within the center portion 34 beginning from the opening 20 and extending toward the top portion 35 of the plate. The depth of the indentation 36 gradually decreases along the extension and fades when the indention 36 reaches the top portion 35 of the plate. The indentation 36 allows the wall material 8 delivered from the opening 20 to be evenly spread along the indention 36. Therefore, as the two flat surfaces 30 and 32 and the center portion 34 slide along the adjacent wall surfaces 2 and 3 and the wall corner 5 or 7, the wall material 8 delivered from the back surface opening 20 will spread evenly along the indention 36 and then be smoothed onto the wall surfaces 2 and 3 and the wall corner 5 or 7. Preferably, the two flat surfaces 30 and 32 have a wing shape.

In the embodiment of the tool 10', as shown in FIG. 8, the two flat surfaces 30 and 32 are positioned relative to each other to slide along an outside corner 5 of a wall. The corner angle defined by the two flat surfaces 30 and 32 is less than 180°. Preferably, the angle is about 90°. Alternatively, the two flat surfaces 30 and 32 may be formed relative to each other to slide along an inside wall corner 7 as shown for the tool 10 " in FIG. 12. The corner angle defined by the two flat surfaces 30 and 32 is greater than 180°. In particular, the angle defined by the wall surface is about 270°.

The tool of the illustrated embodiments having a plate with a back surface formed in such a dihedral configuration is very useful for applying wall material to a hole or crack located near or in an inside (or outside) corner of a wall. The dihedral configuration of the plate permits the center portion and the back surfaces of the plate of the tool to be in close contact with the corner and the angular wall surfaces. Thus, while the tool slides along the wall corner, the wall material delivered from the back surface opening of the plate is smoothed onto the wall surfaces and the wall corner by the back surfaces and the center portion of the plate respectively.

The tube 14 of the tools 10, 10', and 10", is connected to the front surface 16 and coupled to the passageway 22 of the plate 12 and in flow communication with the opening 20 through the passageway 22 as shown in FIGS. 3, 7, and 11. Preferably, the tube 14 and the lower portion 27 of the plate 12 defines an angle which is less than 90°. More preferable, the angle is about 45°. The tube 14 may function as a grip to grip the tool to the source nozzle, to support the movement of the plate 12. To facilitate sliding the tool 10 along a wall surface, an angle of less than 90°, and more particularly, the angle of approximately 45 ° between the tube 14 and the lower portion 27 of the plate 12 is preferred to permit one to apply the wall material on the wall surface smoothly and evenly with a reduced effort.

Figure 2:
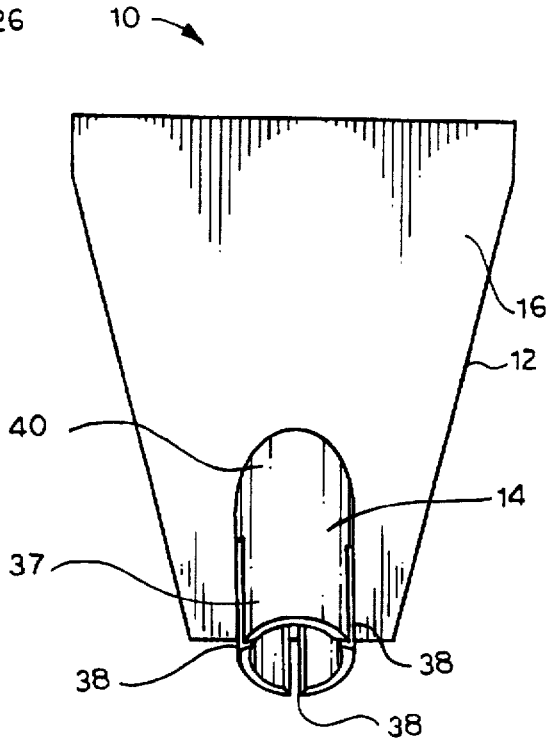
FIG. 2 shows a front perspective view of the tool of FIG. 1.

The tube 14 is adapted to receive the nozzle 4 of a wall material source 6. In a preferred embodiment, the tube 14 has an elongated cylindrical body defining a cavity 39. The cylindrical body has a distal end 37 and a proximal end 40. Preferably, the outside diameter of the tube 14 is larger than the diameter of the opening 20 of the plate 12. The inside diameter of the tube 14 gradually decreases from the distal end 37 to the proximal end 40 such that the inside diameter of the proximal end 40 is approximately the same as the diameter of the opening 20 and therefore the inside cavity 39 of the tube 14 is gradually tapered toward the opening 20 of the plate 12 as shown in FIG. 3. Preferably, the tube 14 has multiple longitudinal expansion channels 38 disposed parallel to each other in equal distance on the tube as shown in FIG. 2. Each channel 38 has a length less than the length of the tube 14 and permits the tapered cavity 39 of the tube 14 to expand in size. Thus, the tapered cavity 39 of the tube 14 permits the tube to receive and frictionally secure nozzles 4 having different diameter sizes. With a nozzle 4 held within the tube 14 by friction, wall material 8, dispensed from the nozzle 4, will be delivered through the tube 14 to the opening 20 of the plate 12, to be applied to the wall surface 2.

The present invention may be embodied in other specific forms without departing from its essential characteristics. The described embodiment is to be considered in all respects only as illustrative and not as restrictive. The scope of the invention is, therefore, indicated by the appended claims rather than by the foregoing description. All changes which come within the meaning and range of the equivalence of the claims are to be embraced within their scope.

I claim:

1. A tool for use in connection with a wall material source having a nozzle to dispense wall material to be applied to a wall surface, comprising:

a plate having a front surface, and a back surface for sliding along the wall surface, said back surface having an opening, and said plate having a passageway passing through the plate and coupled to the back surface opening; and a tube connected to the front surface of the plate and coupled to the passageway for receiving the nozzle of the wall material source;

wherein the periphery of the back surface of the plate has a top portion and defines an indentation beginning from the opening on the back surface and extending toward the top portion of the back surface, wherein the depth of the indentation gradually decreases along the extension and becomes zero when the indentation reaches the top portion of the plate; and further wherein the plate passageway directs the wall material dispensed from the source nozzle to the back surface opening to be delivered for application to the wall surface by the back surface of the plate.

2. The tool of claim 1, wherein the plate has a truncated triangular shape with the truncated apex as the lower portion of the plate for facilitating even spreading of the wall material along the back surface of the plate.

3. The tool of claim 2, wherein the top portion of the plate has a rectangular shape for smoothing the wall material to the wall surface.

4. The tool of claim 2, wherein the indentation has a triangular shape with an apex of the triangle beginning from the opening of the plate, such that the wall material delivered from the opening will spread along the triangular shaped indentation.

5. The tool of claim 4, wherein the plate comprises a protrusion located on the back surface of the plate within the triangular shaped indentation for distributing wall material within the indentation.

6. The tool of claim 5, wherein the plate comprises 6 triangular shaped protrusions arranged in a triangular fashion with respect to one another within the triangular indentation.

7. The tool of claim 6, wherein the height of each triangular shaped protrusion at a particular location is the same as the depth of the indentation at that location, so that the top surface of the protrusion and the periphery of the back surface of the plate share a same plane for smoothly applying the wall material to the wall surface.

8. The tool of claim 1, wherein the back surface of the plate comprises a center portion, the opening and the indentation are located in the center portion; and two flat surfaces extending radially from the center portion and being coupled at an angle in order for each of the two flat surfaces to slide along one of a pair of wall surfaces of a wall corner so that the wall material delivered from the back surface opening of the plate is smoothed onto the wall surfaces and the wall corner by the plate back surfaces and the center portion as the flat surfaces and center portion slide along the adjacent wall surfaces and the wall corner respectively.

9. The tool of claim 8, wherein each of the flat sides has a wing shape.

10. The tool of claim 9, wherein the two flat surfaces are coupled at an angle which allows each of the two flat surfaces to slide along one of a pair of wall surfaces of an inside wall corner.

11. The tool of claim 9, wherein the two flat surfaces are coupled at an angle which allows each of the two flat surfaces to slide along one of a pair of wall surfaces of an outside wall corner.

12. The tool of claim 1, wherein the tube forms an angle which is less than 90 ° with the bottom portion of the front surface of the plate.

13. The tool of claim 12, wherein the angle is about 45°.

14. The tool of claim 1, wherein the tube has an elongated cylindrical body with a proximal end and a distal end, the outside diameter of the tube is larger than the diameter of the opening, and the inside diameter of the tube is gradually tapered from the distal end to the proximal end.

15. The tool of claim 1, wherein the inside diameter of the proximal end is approximately the same as the diameter of the opening.

16. The tool of claim 14, wherein the tube comprises a longitudinal channel disposed on the tube having a length less than the length of the tube, said tube being shaped to receive and frictionally secure the shaped nozzle.

17. The tool of claim 16, wherein the tube comprises three longitudinal channels disposed parallel and equidistant to each other on the tube.

18. A tool for use in connection with a wall material source having a nozzle to dispense wall material to be applied to a wall surface comprising:

a truncated triangular shaped plate having a top portion, a bottom portion, a front surface, and a back surface for sliding along the wall surface, said back surface having an opening, and said plate having a passageway passing through the plate and coupled to the back surface opening;

said plate back surface having a triangular indentation with the apex of the triangle beginning from the opening on the back surface and extending toward the top portion of the plate, wherein the depth of the indentation gradually decreases along the extension and becomes zero when the indentation reaches the top portion of the plate back surface;

six triangular shaped protrusions arranged in a triangular fashion with respect to one another within the indentation wherein the height of each protrusion at a particular location is the same as the depth of the indentation at that location, such that, when the back surface of the plate is slid along the surface of the wall, the wall material delivered from the opening will spread along the indentation to the top portion of the plate and be smoothed to the wall surface evenly;

a tube connected to the front surface of the plate and coupled to the passageway of the plate at an angle less than 90° with the bottom portion of the front surface of the plate to receive the nozzle of the wall material source, wherein the tube has an elongated cylindrical body with a proximal end and a distal end, the outside diameter of the tube is larger than the diameter of the opening, and the inside diameter of the tube tapers gradually from the distal end to the proximal end such that the inside diameter of the proximal end is approximately the same as the diameter of the opening and wherein the tube has three longitudinal channels disposed parallel and equidistant to each other on the tube and each channel has a length less than the length of the tube such that the tube can frictionally receive a nozzle.

19. A tool for use in connection with a wall material source having a nozzle to dispense wall material to be applied to a wall surface, comprising:

a plate having a top portion, a bottom portion, a front surface, and a back surface, wherein the back surface comprises a center portion, and two substantially wing shaped flat surfaces extending radially from the center portion; said back surface having an opening located at the center portion of the back surface; said plate having a passageway passing through the plate and coupled to the back surface opening; said wing shaped flat surfaces are coupled at an angle in order for each of them to slide along one of a pair of wall surfaces of a wall corner so that the wall material delivered from the back surface opening of the plate is smoothed onto the wall surfaces and the wall corner by the wing shaped flat surfaces and the center portion as the flat surfaces and center portion slide along the wall surfaces and the wall corner respectively;

an indentation located within the center portion beginning from the opening on the back surface and extending toward the top portion of the plate, wherein the depth of the indentation gradually decreases along the extension and becomes zero when the indentation reaches the top portion of the plate such that, when the back surface of the plate is sliding along the wall surface and the corner, the wall material delivered from the opening will spread along the indentation to the top portion of the plate and be smoothed to the wall board surface evenly;

a tube connected to the front surface of the plate and coupled to the passageway of the plate at an angle less than 90 ° with the bottom portion of the front surface of the plate to receive the nozzle of the wall material source, wherein the tube has an elongated cylindrical body with a proximal end and a distal end, the outside diameter of the tube is larger than the diameter of the opening, and the inside diameter of the tube tapers gradually from the distal end to the proximal end such that the inside diameter of the proximal end is approximately the same as the diameter of the opening and wherein the tube has three longitudinal channels disposed parallel and equidistant to each other on the tube and each channel has a length less than the length of the tube such that the tube can frictionally receive a nozzle.

20. The tool of claim 19, wherein the two flat surfaces are coupled at an angle which allows each of the two flat surfaces to slide along one of a pair of wall surfaces of an inside wall corner.

21. The tool of claim 19, wherein the two flat surfaces are coupled at an angle which allows each of the two flat surfaces to slide along one of a pair of wall surfaces of an outside wall corner.

* * * * *